US005906837A

United States Patent [19]

Link et al.

[11] Patent Number: 5,906,837

[45] Date of Patent: May 25, 1999

[54] DEVICE FOR PRODUCING PRESSED ARTICLES

[75] Inventors: Rainer Link, Mönchengladbach; Klaus Vossen, Meerbusch; Matthias Holthausen, Wassenberg; Norbert Nies, Neuss, all of Germany

[73] Assignee: Mannesmann Aktiengesellschaft, Düsseldorf, Germany

[21] Appl. No.: 08/776,371

[22] PCT Filed: Jul. 13, 1995

[86] PCT No.: PCT/DE95/00954

§ 371 Date: Jan. 29, 1997

§ 102(e) Date: Jan. 29, 1997

[87] PCT Pub. No.: WO96/04087

PCT Pub. Date: Feb. 15, 1996

[30] Foreign Application Priority Data

Aug. 2, 1994 [DE] Germany ..... 44 28 842

[51] Int. Cl.[6] ..... B22F 3/03; B22F 5/08

[52] U.S. Cl. ..... 425/78; 425/150; 425/352

[58] Field of Search ..... 425/78, 149, 150, 425/352, 354, 355

[56] References Cited

U.S. PATENT DOCUMENTS 3,677,672 7/1972 Harrington ..... 425/78

3,694,127 9/1972 Takahashi et al. ..... 425/78

3,891,367 6/1975 Signora ..... 425/78

5,259,744 11/1993 Take ..... 425/78

5,366,363 11/1994 Good et al. ..... 425/78

*Primary Examiner*—James P. Mackey

*Attorney, Agent, or Firm*—Cohen, Pontani, Lieberman & Pavane

[57] ABSTRACT

A device for producing pressed articles with a main cylindrically-shaped elements and secondary helically-shaped element from powdered material, especially powdered metal, with a female mold and with at least one top punch, which is supported so as to be rotatable about its longitudinal axis, and at least one bottom punch, which is supported so as to be rotatable about its longitudinal axis. The top and bottom punches are movable axially relative to the female mold by means of motor drives and the top punch, of which there is at least one, is driven in rotation about its longitudinal axis to achieve a helical movement in addition to its axial drive the bottom punch, of which there is at least one, is also driven in rotation. Rotary motor drives of the punches are mechanically uncoupled from the drives for the axial movement of the punches and may be regulated separately by an electronic control.

15 Claims, 1 Drawing Sheet

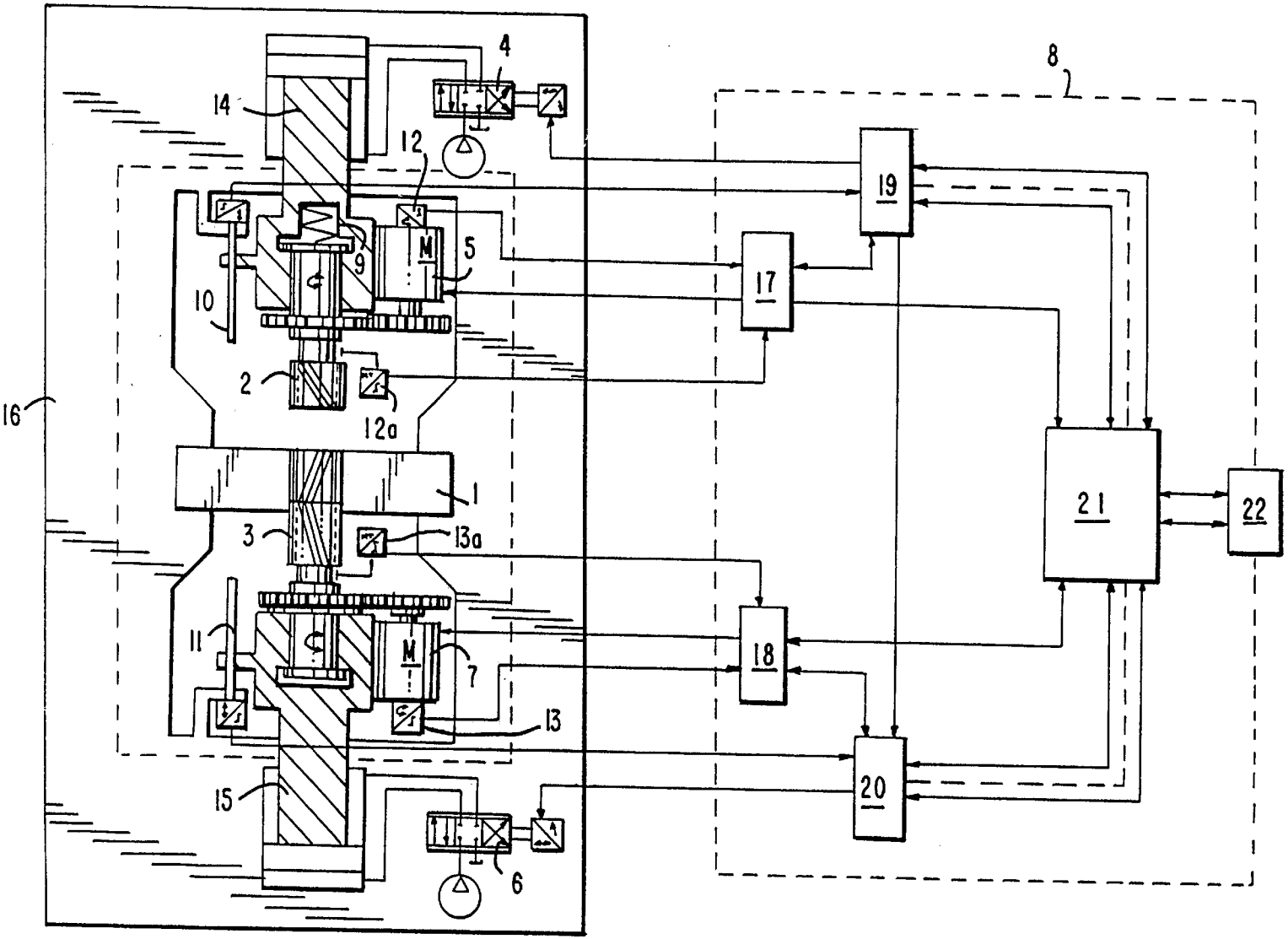
22
21
8
19
20
17
18
4
5
12
9
14
10
2
12a
1
13a
3
7
13
11
15
6
16

DEVICE FOR PRODUCING PRESSED ARTICLES

BACKGROUND OF THE INVENTION

1. Field of the Invention

The invention is directed to a device for producing compacted or pressed articles with a main cylindrically-shaped element and a secondary helically-shaped element from powdered material such as powdered metal, and in particular for producing helical gearwheels in which the helical gearing or toothing is the secondary element.

2. Description of the Related Art

A conventional device as described in European Patent Publication 0 528 761 A1 produces pressed articles, e.g., helical-toothed gearwheels, from metal powder. This known metal powder press has a linearly movable upper ram in which is supported a top punch which is rotatable about the longitudinal axis in the pressing direction and a bottom ram which is also moveable linearly against a bottom stop and in which a bottom punch is rotatably supported. A die plate forms a mold cavity and is movable linearly in the pressing cycle. The rotatable bottom punch and the rotatable top punch each have a toothing profile corresponding to the toothing profile or helical toothing of the mold shell or casing, i.e., the mold cavity. The bottom punch which is supported so as to be freely rotatable is constantly engaged with the profile of the mold cavity and therefore rotates compulsorily in a corresponding manner when linear relative movements occur between the bottom punch and die plate during the press cycle. In contrast, a rotational movement corresponding to the helical toothing is externally forced upon the top punch during the press cycle corresponding to its penetration depth in order to reduce the friction between the outer surfaces of the top punch and mold cavity of the female mold. The toothed-wheel mechanism provided for this purpose is driven via a mechanical linkage control corresponding to the desired helical toothing of the pressed article. The linkage control contains linkage cores, rigidly connected to a guide plate and guided in a positive engagement and in a sliding manner in the coaxially arranged driving wheels of the toothed-wheel mechanism. During the press cycle, the guide plate is temporarily rigidly coupled with the die plate and moves jointly therewith. A withdrawal process is used to remove the produced pressed articles from the mold.

This known metal powder press gives rise to considerable costs with respect to mechanical construction and also retooling since for every different pressed article a set of linkage cores corresponding to this pressed article must be prepared and exchanged, aside from the special tool set including the female mold, top punch and bottom punch. Added to this is the cost of the guide plate and the mechanically operated locking device for rigidly coupling the guide plate to the die plate. There also remains the problem of friction between the bottom punch with respect to its rotational movement and the female mold, the bottom punch not being positively driven externally. This not only results in increased tool wear in this region, but also leads to an uneven density distribution in the pressed article.

A press with electronically controlled movements which is used for the rotary press process is described in the publication entitled "Quality control through process monitoring of rotary forming press", Metal Powder industries Federation, Volume 6, May 6–11, 1994, 125–137. A press of this type is used for subsequent treatment of already sintered molded articles produced by powder metallurgy in order to give them a density in the range of 95% to 98% of the theoretically possible density of the material in question. The special construction of these presses makes it possible to generate extremely high local pressing pressures in the pressing tool with a comparatively low overall pressing force of the press. The special construction for this purpose includes an upper punch die that moves in a gyrating and rotating manner and applies locally defined extremely high pressing forces on the workpiece in order to compact the latter in directed manner. This reference contains no suggestion that the top punch and bottom punch, which participate directly in the shaping of the helically shaped secondary element of the article to be pressed, may be controlled with respect to their movement in the mold cavity of the female mold by electronic means for the purpose of producing compact with main cylindrically shaped elements and secondary helically shaped elements from powdered material.

SUMMARY OF THE INVENTION

The object of the invention is to improve a generic device in such a way that the friction problems mentioned above with regard to the bottom punch are solved satisfactorily, while the tool cost and expense of retooling for production of different pressed articles remains as low as possible.

A substantial feature of the invention consists in that the top punch and bottom punch which directly participate in the shaping of the secondary helically shaped element of the pressed article to be produced, for example, in gearwheels with a plurality of toothings arranged axially in succession, a corresponding plurality of bottom or top punches may be required are guided by an electronic control with respect to their movement in the mold cavity of the female mold. The rotational movement of the bottom punch and top punch, depending upon the depth to which the latter penetrate into the mold cavity, is ensured by an electronically regulated, separate i.e., mechanically uncoupled rotary drive and is thus no longer effected by the mechanical coupling of a linear and rotary drive, i.e., no longer exclusively by the friction between the punch contour and the outer surface of the female mold as is the case with the bottom punch shaping one broad side in the press as described in European Patent Publication EP 0 528 761 A1, or by mechanical sensing of a linkage core as is the case with the top punch in this known press which shapes the other broad side. This means that the simultaneous rotational movement corresponding to the lead or pitch of the secondary helically shaped element and the linear movement must be effected with an accuracy lying within the tool play of the toothing between the punches and the female mold. Accordingly, the axial and rotational movement of the punches is effected in a position closed loop controlled regulated manner. Suitable sensors are provided for determining the respective axial and rotational position e.g., linear potentiometer or incremental measurement means for linear movement and rotational angle transmitters for rotation. In this regard, it will be noted that the female mold is advisably held in a stationary manner in the utilized powder press while the top punch and bottom punch are moved linearly and rotationally. Of course, modifications are also possible in the sense of a kinematic reversal, e.g., in that the female mold may be held so as to be rigid with respect to rotation but accompanies the linear movement, as in the press discribed in European Patent Publication EP 0 528 761 A1, wherein the bottom punch is rotated in place, while the top punch is moved linearly and rotationally. In principle, the female mold could also be moved in rotation. This may be a meaningful addition to the rotational movability of the bottom punch and top punch or bottom punches and top punches when producing, e.g., multiple gearwheels, that is, pressed articles with a plurality of toothings of various width or with different helix angles disposed one after the other axially. In a known manner, core punches may also be provided in addition to the bottom punches and top punches. These core punches may moved by auxiliary drives and form a hub at a toothed wheel so that the toothed wheel may be placed on a shaft.

The electronic control for the movement sequence of the top punch or top punches may be so arranged that only a purely linear movement takes place outside of the mold cavity of the female mold and the required rotational movement in the press cycle is initiated immediately with the penetration into the mold cavity, and not until then. In this case, it is advisable to provide the top punch or top punches with a comparatively soft, resilient bearing which is defined by a stop in order to allow sufficient time for the acceleration process when starting the rotating movement. Position and torque are not regulated until the top punch has moved to the stop. This prevents damage to the tool during penetration.

Position regulation of the movement sequences is not always necessary for carrying out the present invention. As an alternative or in addition to the position regulation, the rotational movement sequences of the top punch and bottom punch relative to the female mold may be set in a predetermined manner, e.g., torque values are constant with respect to time. The rotary drives of the top punch and bottom punch are adjusted in such a way in the press phase that the tooth faces of the punches and mold shell contact one another as far as possible only on the side which would not otherwise be exposed to a direct mutual friction in the absence of a rotary drive when the punches move into the mold cavity of the female mold. Thus, the externally applied torque acts in the direction of the rotating movement compelled by the mold. In a preferred embodiment, the torques of the rotary drives may be regulated, i.e., increased as the pressing force increases, as a function of the pressing force actually achieved or as a function of the achieved penetration depth, i.e. axial position of the punches. It is particularly advantageous to measure the torsional moment at the punches and to set the driving torque precisely to a value at which the friction losses in the bearing and drive system are compensated, i.e., the torsional moment at the punches approaches zero. The rotary drives of the punches are preferably completely shut off in the very last segment x of the press phase, i.e., shortly before reaching the end position of the press, in order to prevent cracks due to torsional stresses. At a helix angle β of the toothing, this segment x must meet the following condition:

$$x \leqq s \cdot \cot \beta$$

The value s equals the transverse tool play. Accordingly, a 30-degree toothing and a tool play of 0.03 mm, for example, produces a segment $x \leqq 0.05$ mm.

In principle, the pressed article which is produced may be ejected from the mold by the ejection method without switching on rotary drives. However, the rotary drives are preferably used in a corresponding partially reverse manner compared with the compacting process. This ensures the gentlest possible treatment of the tool and pressed article.

Hydraulic drives should be used for the linear movement of the top punch and bottom punch or the moving female mold, as the case may be. The rotary drives may likewise be actuated hydraulically and in many cases, may also be operated pneumatically. Electric-motor rotary drives are preferred, especially electric stepping motors or servomotors. The invention is preferably used in connection with a CNC powder press. In another embodiment or modification the substantially mechanical parts of the device according to the invention such as the punches, female mold and rotary drives are designed as an exchangeable unit in the form of a tool adapter so as to enable especially short retooling times.

The present invention is advantageous in that it enables the manufacture, for example, of helical gearwheels with extremely low tool wear, since the friction in the region of the tooth flanks may be limited to a minimum during the pressing phase as well as the when ejecting from the mold. The retooling cost may also be considerably reduced compared with known pressing tools, since only programming steps need be carried out rather than the manufacture of linkage cores to effect the rotary driving. Further, when the respective powder press is provided for producing a plurality of different pressed articles, as is typical this leads to substantial savings on investment costs in spite of the extra expenditure required for the rotary drives and the measuring and regulating means. Finally, it should be emphasized that the device according to the present invention produces pressed articles having an appreciably more uniform density distribution than was heretofore possible.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings:

The FIGURE is a schematic top view of a metal powder press in accordance with the present invention.

DETAILED DESCRIPTION OF THE PRESENTLY PREFERRED EMBODIMENTS

The hydraulic press shown in FIGURE includes a press frame 16 which is outfitted with an upper ram 14 and a bottom ram 15. A female mold 1 is supported approximately in the center of the press frame 16 so as to be stationary and rigid with respect to rotation. A top punch 2 is rotatably supported in the upper ram 14 and a bottom punch 3 is rotatably supported in the bottom ram 15. The top punch 2 is supported so as to be flexible in the pressing direction by means of a pretensioned spring 9 which presses the receiving device for the top punch 2 in the pressing direction against a fixed stop. The force of the spring, whose travel is defined by a stop, is always appreciably less than the maximum pressing force for the tool, so that the top punch is at the stop before the start of the pressing process. The casing or shell of the female mold 1 and the two punches 2, 3 have a helical toothing corresponding to one another. Two path measurement systems 10, 11 are provided for a highly precise determination of the respective linear position of the two rams 14, 15 and, accordingly, also of the punches 2 and 3 connected therewith. These path measurement systems 10, 11 can be constructed, for example, as incremental measuring means or linear potentiometer. A rotary drive 5 and 7 e.g., an electric servomotor is attached to each of the two rams 14, 15, its actual rotational angle position being determined continuously by a combined angle and torque measurement system 12 and 13, respectively. The punches 2, 3 have measurement devices 12*a*, 13*a* for detecting the actual torsional moment. The two rotary drives 5, 7 are connected, via a spur gear unit, with one of the two punches 2 or 3 in a manner consistent with drive engineering. Two servo-proportional valves 4, 6 are provided for positioning the two rams 14, 15 of the press. The press shown in the FIGURE includes an electronic control 8 enclosed in dashed lines which is designed hierarchically in itself and is formed of a CNC main processor 21, a regulating unit 19 and 20 for the linear movement of the upper ram 14 and bottom ram 15 and a regulating unit 17 and 18 for the rotational movement of the two punches 2 and 3. An input/output unit of the CNC main processor for controlling and setting up the press via the operator is designated by 22. The data processing link between the electronic component units and sensors is shown by corresponding arrows. The two regulating units 19, 20 are subordinate to the CNC main processor 21 and the regulating units 17, 18 for the rotational movement are subordinate as slaves to one of the two regulating units 19 or 20 for the linear ram movement. In the present example, the regulating unit 19 is subordinate as master to the regulating unit 20 submaster, i.e., the movement of the upper ram 14 and the movement of the top punch 2, is used as a guidance variable for the movement sequence. The combined angle and torque measurement system 12 together with the rotary drive 5 and the regulating unit 17 forms a closed loop, whereby the regulating unit 17 receives its reference value from the regulating unit 19 of the linear drive of the ram 14 corresponding to its current axial position as determined by the path measurement system 10. This holds true in a corresponding sense for the structural component units for the drive of the bottom punch 3 which operate in the same way, its linear position being regulated as a function of the linear position of the top punch 2. The CNC main processor 21 takes over higher-ranked regulating and controlling functions and the processing of the preset data for the respective part to be produced. A dashed box inside the press frame 16 indicates the main functional parts of the device according to the invention in the form of a tool adapter which may be combined in an easily exchangeable structural component unit that is connectable with the top and bottom rams 14, 15.

The press of the present invention operates in the following manner: After a pressed article is removed from the mold, the bottom punch 3 is moved down into the filling position in a position closed loop controlled manner based on the actual values determined by the path measurement system 11 and the angle measurement system 13 corresponding to the helix angle of the helical gearwheel to be produced. In particular, adjustment of position of the punch is achieved by detecting the actual position using the path measuring system 10 and torsional measuring system 12, comparing the detected position with the intended position, and adjusting the position accordingly based on the difference. The bottom punch 2 remains in the mold cavity of the female mold 1. The top punch 2 is located above the mold cavity. After the mold cavity is filled with powdered steel, the top punch 2 is moved down in a position closed loop controlled manner by means of the regulating unit 19 based on the data from the path measurement system 10. At the same time, a coordinated rotating movement of the top punch 2 is initiated via the regulating unit 17, the angle measurement system 12, and the rotary drive 5, so that the relative rotational position of the top punch 2 with respect to the toothing contour of the mold cavity of the female mold 1 allows the top punch 2 to penetrate into the mold cavity without making contact. This is the start of the actual pressing phase in which the introduced powdered steel is compacted. For this purpose, the bottom punch 3 and the top punch 2 are moved into the mold cavity in opposite directions simultaneously while the female mold 1 remains stationary. The rotary drives 7 and 5 ensure a minimum of friction between the punches 2, 3 and the female mold 1. Since the two angle measurement systems 12, 13, as combined instruments, are also set up to detect the driving torque, a regulation of torque can also be effected depending on the axial position of the punches 2, 3 in addition to, or in lieu of, the position regulation of the rotary drive 5, 7. After reaching the end position of the press, the drive system of the top punch 2 is reversed to remove the produced pressed article from the mold, i.e., the top punch 2 is moved out of the mold cavity linearly and rotationally in a position-regulated manner corresponding to the contour of the pressed article. At the same time, the bottom punch 3 is likewise moved upwards correspondingly in a position closed loop controlled manner until its upper end face is flush with the top of the female mold 1 and the pressed article is accordingly released ejection process. The pressed article can be purposely held under a desired pressing load during the ejection process.

The invention is not limited by the embodiments described above which are presented as examples only but can be modified in various ways within the scope of protection defined by the appended patent claims.

We claim:

1. A system for producing a pressed article with a main cylindrically-shaped element and a secondary helically-shaped element from powdered material, comprising:

a press frame;

a female mold disposed within said press frame and defining a mold cavity;

at least one top punch disposed within said press frame for operative helical rotational movement about its longitudinal axis and axial movement relative to said female mold;

at least one bottom punch disposed within said press frame for operative rotational movement about its longitudinal axis and axial movement relative to said female mold;

electronic rotary motors operatively connected for rotatingly driving respective said top and bottom punches;

electronic axial motors operatively connected for axially driving respective said top and bottom punches, said axial motors being uncoupled from said rotary motors; and an electronic control device operatively connected to drive and independently regulate said rotary and axial motors, said electronic control device controlling the axial and rotational movements of said top and bottom punches in the mold cavity of the female mold so as to directly shape the helically shaped secondary element of the article to be pressed.

2. The system of claim 1, wherein said electronic control device is operatively adapted to control said top punch so that it is axially displaced to penetrate into the mold cavity of the female mold without said top punch being rotated.

3. The system of claim 1, further comprising a spring operatively displaced in an axial direction by said top punch.

4. The system of claim 1, wherein said electronic control device is operatively adapted to control the rotational movement of said top and bottom punches during compacting of the article to be pressed in a position regulated manner.

5. The system of claim 1, wherein said electronic control device is operatively adapted to control the rotational movement of said top and bottom punches during compacting of the article to be pressed based on predetermined torque values.

6. The system of claim 5, wherein said electronic control device controls the rotational movement of said punches at a constant rate over time.

7. The system of claim 4, wherein said electronic device controls the rotational movement of said punches during compacting of the article in a first direction and during ejection, after the article has been pressed, in a corresponding reverse direction.

8. The system of claim 1, wherein said axial motors are hydraulic motors.

9. The system of claim 1, wherein said rotational motors are hydraulic motors.

10. The system of claim 1, wherein said rotational motors are pneumatic motors.

11. The system of claim 1, wherein said rotational motors are electrical stepping motors.

12. The system of claim 1, wherein said rotational motors are servomotors.

13. The system of claim 1, wherein said electronic control device includes a CNC main processor.

14. The system of claim 1, wherein said female mold, said top punch and said bottom punch comprise a tool adapter.

15. The system of claim 1, wherein said female mold is rigidly supported in said press frame.

* * * * *